US006370727B1

(12) United States Patent
Yurt et al.

(10) Patent No.: US 6,370,727 B1
(45) Date of Patent: Apr. 16, 2002

(54) WASH STAND FOR VENETIAN BLINDS

(76) Inventors: Wanda M. Yurt; Alvin C. Yurt, both of 1956 Sullivan La., Bardstown, KY (US) 40004

( * ) Notice: Subject to any disclaimer, the term of this patent is extended or adjusted under 35 U.S.C. 154(b) by 0 days.

(21) Appl. No.: 09/607,378

(22) Filed: Jun. 30, 2000

(51) Int. Cl.[7] ..... A47L 4/04
(52) U.S. Cl. ..... 15/268; 248/125.3; 248/166
(58) Field of Search ..... 15/268; 248/125.3, 248/165, 166, 257, 263, 407, 440, 447

(56) References Cited

U.S. PATENT DOCUMENTS 2,598,798 A * 6/1952 Kerr
2,849,745 A * 9/1958 Madsen
2,908,932 A * 10/1959 Shipp
4,572,467 A * 2/1986 Farrell

* cited by examiner

*Primary Examiner*—Terrence R. Till
(74) *Attorney, Agent, or Firm*—Carrithers Law Office; David W. Carrithers

(57) ABSTRACT

An open frame for supporting a venetian blind facilitating washing the blind. The frame has a pair of spaced apart elongate side members each with a face plate and an end plate and are interconnected by a cross member. The cross member adjustably positions the spacing of the side members to suit blinds of various widths. A pair of saddles are adjustably mounted on the side members for releasibly supporting the top rail of the venetian blind. Pins through the frame are insertable into opposed ends of the bottom rail of the venetian blind.

10 Claims, 10 Drawing Sheets

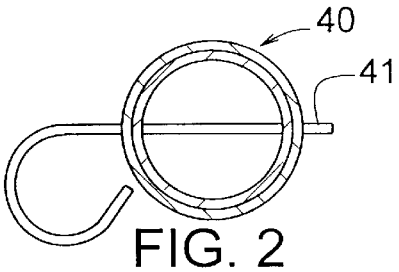
FIG. 2
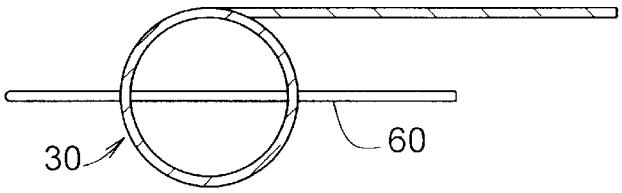
FIG. 3
FIG. 4
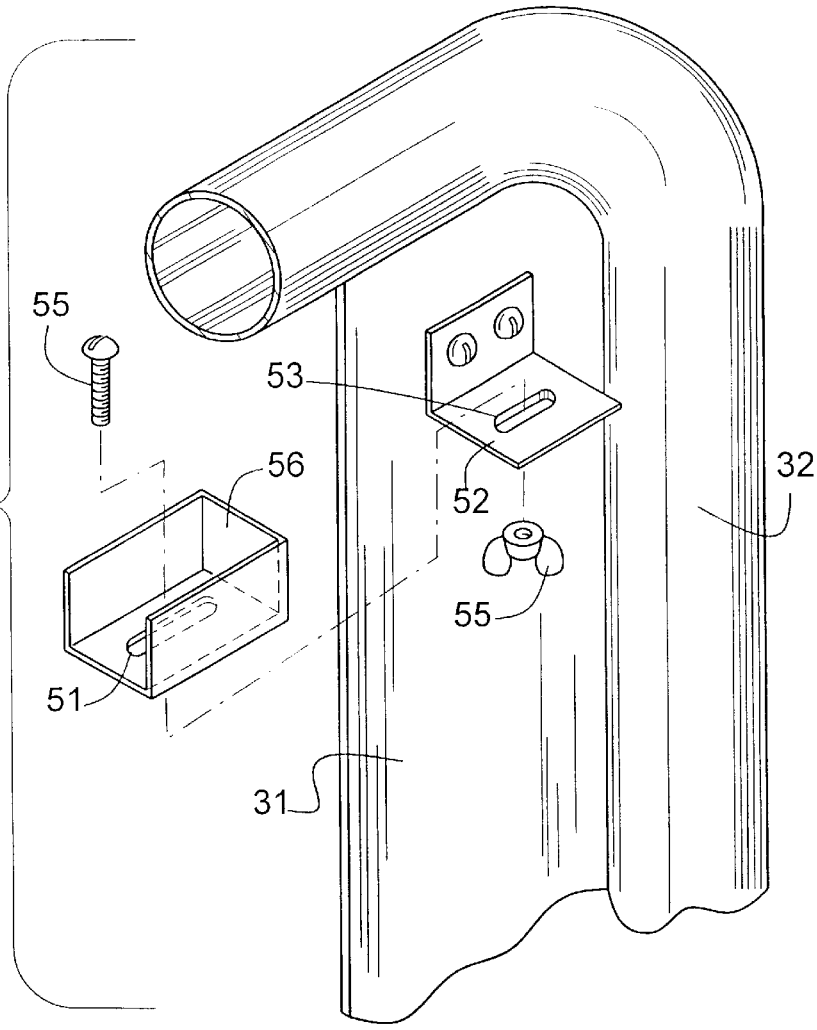

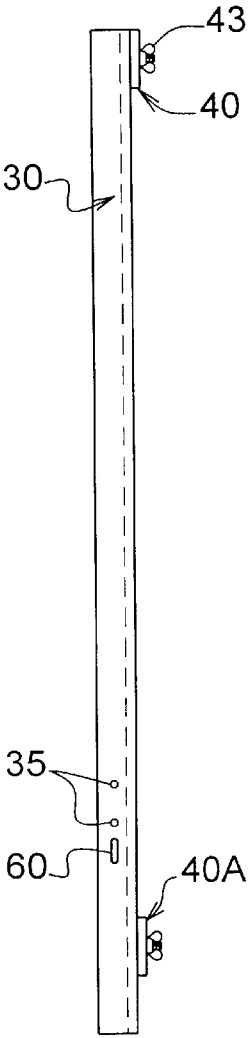
FIG. 10
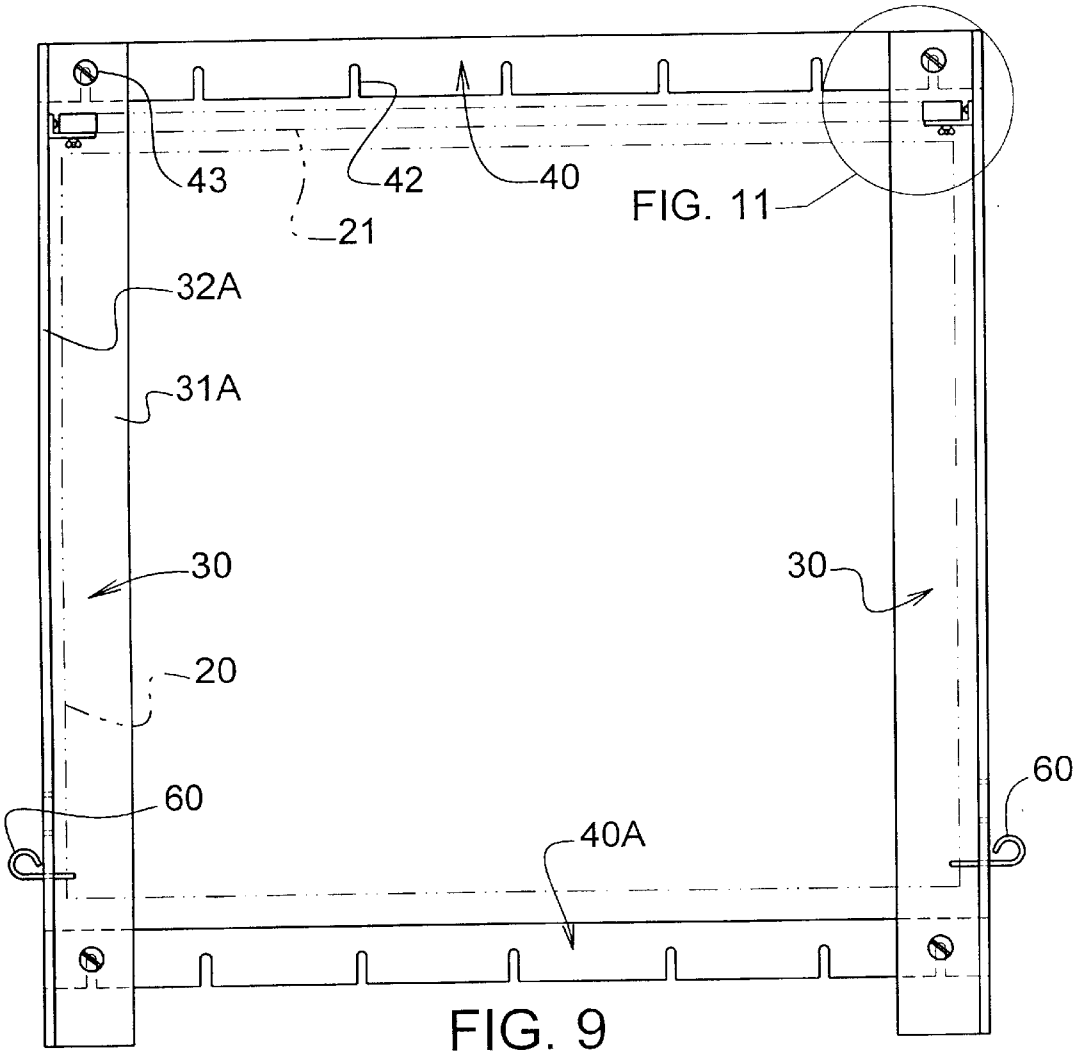
FIG. 9
FIG. 11

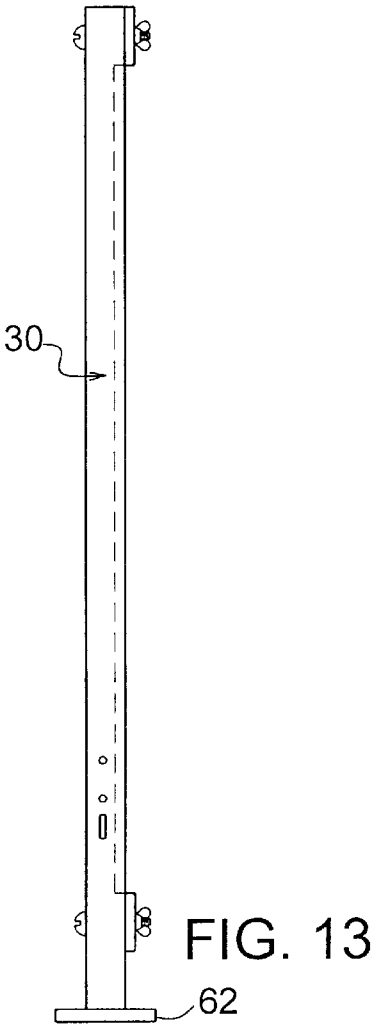
FIG. 13
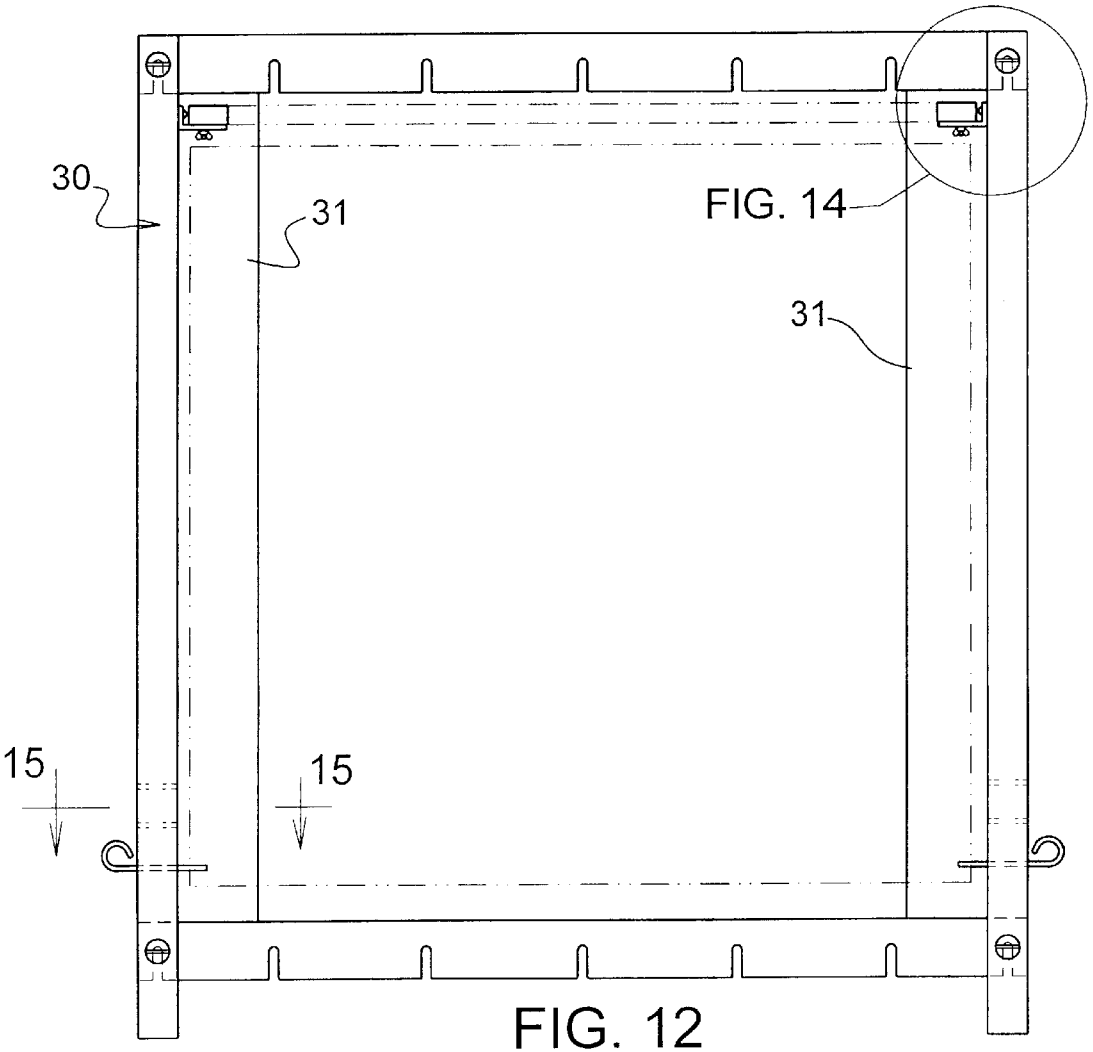
FIG. 12
FIG. 14

WASH STAND FOR VENETIAN BLINDS

BACKGROUND OF THE INVENTION

1. Technical Field

The present invention relates to vertical free standing adjustable open frame to removably receive and hold venetian blinds and in particularly mini-blinds in an expanded "down" position secured to the frame to stabilize the slats during cleaning.

2. Background Information

Cleaning venetian blinds is an onerous task because of the blind having a number of loosely connected slats that move easily during cleaning and due to the fact the long slender individual slats are easily bent.

In an attempt to ease the burden of cleaning a number of different types of blind support stands have been proposed. Most of the proposed support frames provide backing against which the slats can be pressed during wiping with a wash cloth. By way of example of known support stands for use in washing venetian blinds reference may be had to the following United States Patents: U.S. Pat. No. 3,197,797 issued Aug. 3, 1965 to U. Stanley; U.S. Pat. No. 2,996,747 issued Aug. 22, 1961 to J. Iori; U.S. Pat. No. 2,908,932 issued Oct. 20, 1959 to C. Shipp; U.S. Pat. No. 2,849,745 issued Sep. 2, 1958 to E. Madsen; U.S. Pat. No. 2,634,450 issued Apr. 14, 1953 to O Britton; U.S. Pat. No. 2,598,798 issued Jun. 3, 1952 to E. Kerr; U.S. Pat. No. 2,588,557 issued Mar. 11, 1952 to F. Morris et al.; U.S. Pat. No. 2,279,691 issued Apr. 14, 1942 to R. Long et al,; and U.S. Pat. No. 676,337 issued Jun. 11, 1901 to W. Nicholls.

None however, known to applicant, include a portion on the frame to counteract against forces exerted lengthwise of the slat during cleaning. Also very little, if any, attention has been given to providing a simple means of releasibly anchoring the blind to the support or to adjustably varying the frame size to suite different blind widths.

SUMMARY OF THE INVENTION

A vertical wash stand frame removably holds a mini-blind in an upright position so that the mini-blind is in the extended "down" position above the floor surface for washing. The wash stand includes an adjustment for vertical height and horizontal width for holding blinds of different dimensions. It is particularly suitable for standing in the shower or bathtub and washing mini-blinds. One preferred embodiment is collapsible and portable. The open frame for supporting a venetian blind has a pair of spaced apart elongate side members each with a face plate and an end plate and are interconnected by a cross member. The cross member adjustably positions the spacing of the side members to suit blinds of various widths. A pair of saddles are adjustably mounted on the side members for releasibly supporting the top rail of the venetian blind Pins through the frame are insertable into opposed ends of the bottom rail of the venetian blind.

Although any type of standard blind having slats and a head rail could be used with the present invention, mini-blinds such as described and set forth in U.S. Pat. No. 5,348,068 by Elsenheimer et al. and hereby incorporated by reference, are the focal point of the present invention. The wash stand frame includes at least two vertical longitudinal leg support members which may be extendible such as with telescoping means and at least one horizontal member connoting the two leg support members together including means for adjustable extending along the horizontal axis.

Each leg is held steady by a base which may hold both legs or a pair of base members defining a pair of feet may hold each leg individually.

A principal object of the present invention is to provide a frame for holding the slats of a venetian blind captive during cleaning of the blind and a frame which is adjustable in width.

A further principal object of the present invention is to provide a simple anchoring mean to releasibly retain the blind to be washed on the frame.

It is an object of the present invention to hold a mini-blind secure and taut for cleaning.

It is an object to the present invention to provide a support structure which may only utilize eight pieces including two side members, a top member, a bottom member, and two brackets to hold two adjustable blind holders.

It is an object of the present invention to provide a top member and a bottom member which are adjustable in order to accommodate every average size blind, by moving to the desired notched opening and being locked in.

It is another object of the present invention to provide that the top and bottom member may be connected to the connecting side member by a hinge or means for attaching permitting folding of the members for storage.

In keeping with the forgoing there is provided in accordance with the present invention a variable width open frame for use in washing venetian blinds comprising a pair of elongate side members each having a face plate and an end plate engagable respectively with a face portion and an end edge portion of each slat of a venetian blind being cleaned thereon, a cross member adjustably interconnecting said side members at various selected different positions selectively to vary the width of the frame, saddle means on the frame for releasibly supporting the head rail of a venetian blind and movable pin means on said frame to releasibly anchor the bottom rail of the blind to said frame.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 2 is a sectional view taken along line 2—2 of FIG. 1;

FIG. 3 is a sectional view taken along line 3—3 of FIG. 1;

FIG. 4 is an oblique view, on a larger scale, of the encircled portion in FIG. 1 illustrating details of a corner portion of the frame;

FIG. 9 is a front view of a frame illustrating a different structural shape of the frame members;

FIG. 10 is a side elevation view of FIG. 9;

FIG. 12 is a front view of the frame shown in FIG. 9 including face plates extending inwardly form the side members to support the edges of the blind thereon;

FIG. 13 is a side view of FIG. 12;

DESCRIPTION OF THE PREFERRED EMBODIMENT

Figure 1:
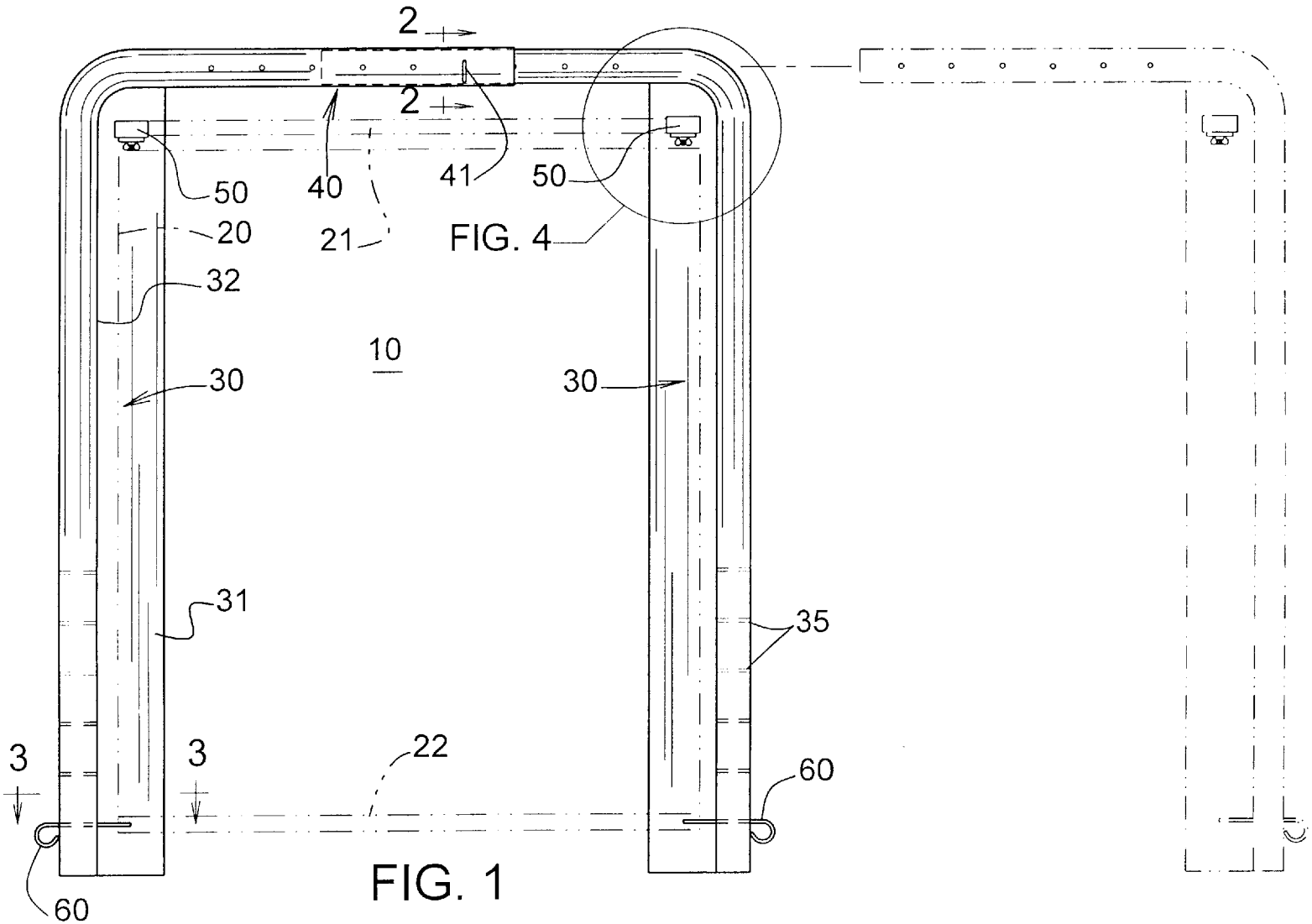
FIG. 1 is a front view of a variable width venetian blind support frame provided in accordance with the present invention.

Referring to the drawings 1–18, there is illustrated an open blind cleaning support frame 10 for supporting a venetian blind 20 during washing the same. The frame has a pair of spaced apart elongate side members 30 interconnected by a cross member 40. It is contemplated that a second cross member 40A may be used to the bottom end of the frame that is connected to the side members as shown best in the embodiment of FIG. 9.

Mounted on the frame are a pair of spaced apart saddles 50 for removably receiving and supporting the upper rail 21 of a venetian blind 20. Means for retaining the blind in an extended manner defining a pair of pins 60 are movably mounted on the frame for projecting into respective opposite open ends of the bottom rail 22 of the blind 20.

Each side member of the frame has a face plate 31 and an end plate 32 engagable respectively with a face portion of a slat adjacent an end thereof and an end edge of the slat. In this manner each slat is held captive against forces applied to it during cleaning thus facilitating washing the blind.

Figure 14:
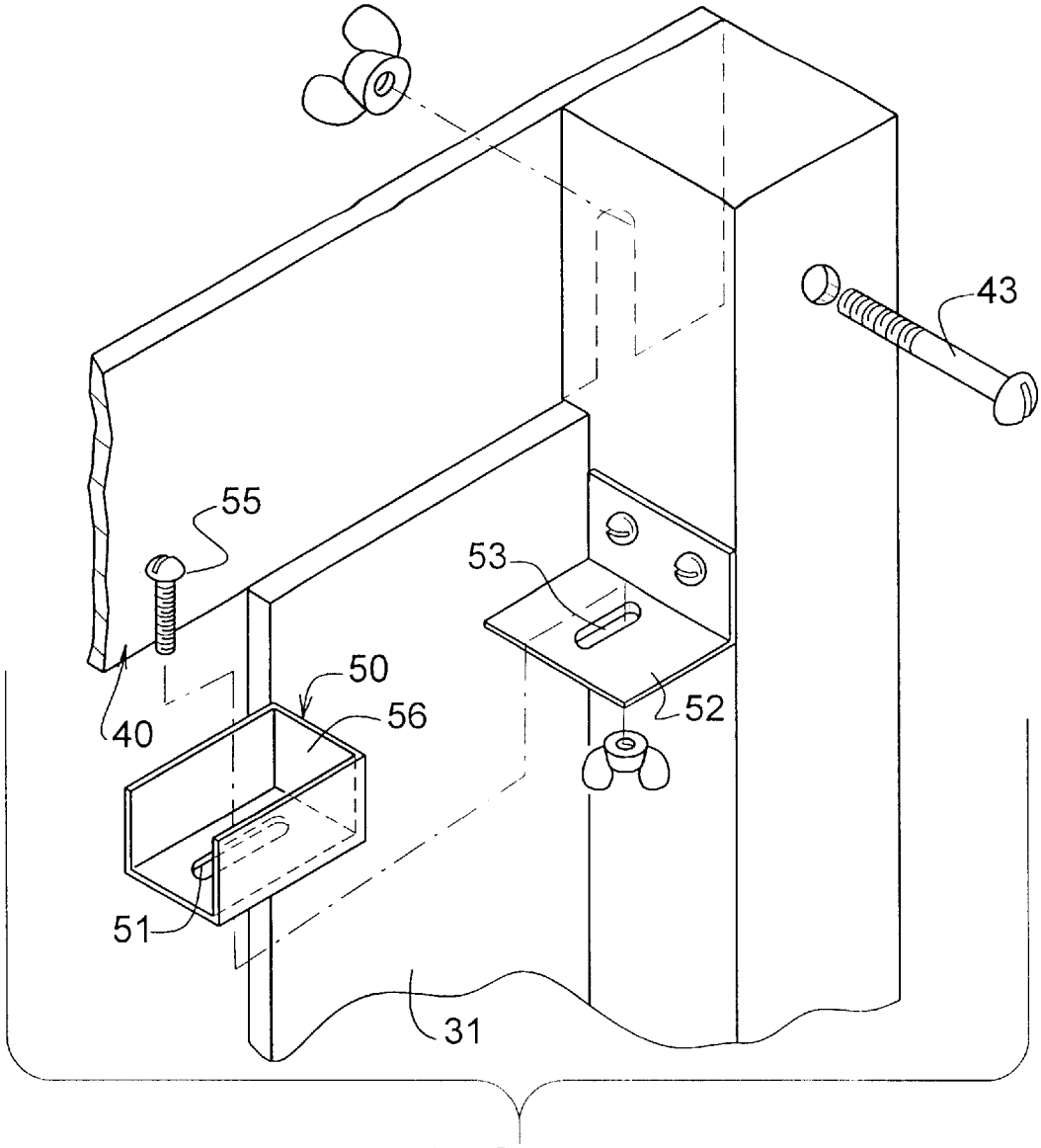
FIG. 14 is an enlarged view showing the attachment of the bracket to a rectangular shaped longitudinal side member.
Figure 15:
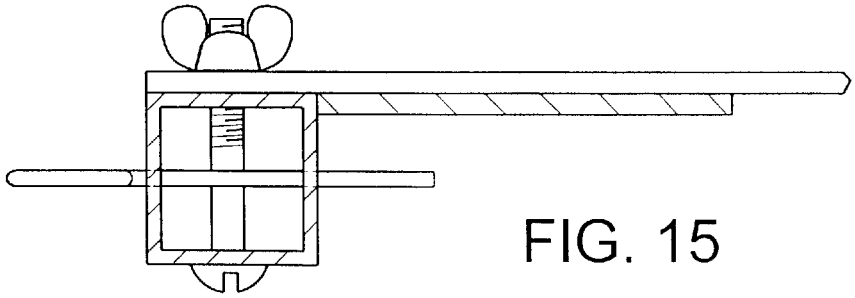
FIG. 15 is a sectional view of FIG. 12 along lines 15—15.
Figure 16:
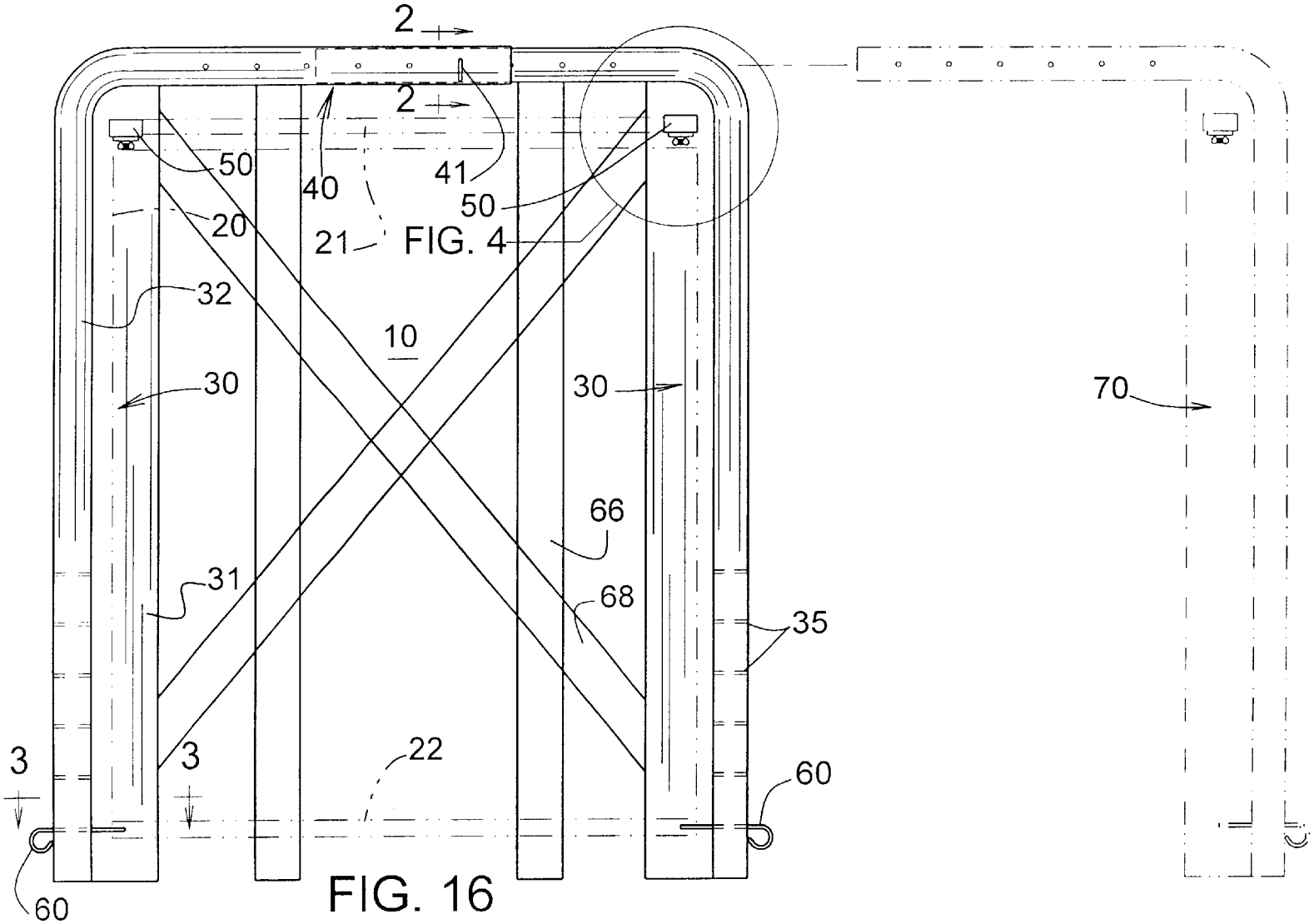
FIG. 16 is a front view of FIG. 1 showing the optional support extending from the top to the bottom of the support stand or diagonally from side to side.

The distance between the two frame side members is selectively adjustable by various means associated with the cross member 40. In the embodiment in FIGS. 1 and 5 the cross member is telescopic and locked at various different positions by inserting a pin 41 through aligned holes in the telescoped portions of the cross member. The telescoping members may also be cooperatively engaged by frictional relationship upon rotating one member coaxially extending within the adjoining member. In the embodiment illustrated in FIG. 9 the cross member has slots 42 extending inwardly from an edge at spaced apart intervals. A bolt and nut unit 43 is used to join a side member to the cross member utilizing a slot that provides a suitable spacing between the side members for the task at hand. As shown in FIG. 14, the side member may be a cylindrical or square tubular member as well as a solid member.

Figure 11:
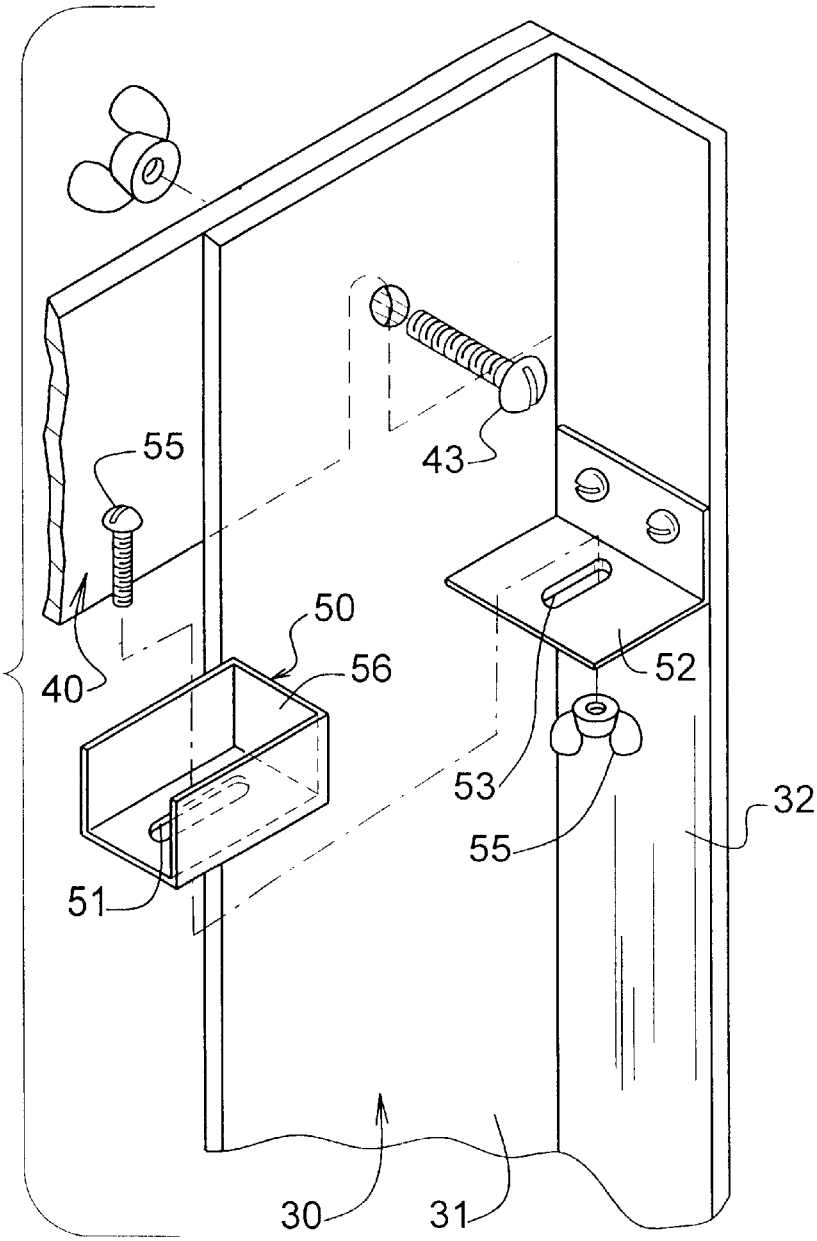
FIG. 11 is an oblique exploded view of the encircled frame corner portion in FIG. 9.

The side members may be tubular stock pieces (circular or square in cross-section ie. (FIGS. 1–4 and 5–8 respectively) with a strap of flat stock or flange secured thereto or simply an angle member illustrated in FIGS. 9–11. All embodiments provide a face plate 31 against which the slat blinds can abut and an end plate 32. Of course, it is contemplated that the side members 30 face plate 31 could be formed integrally as a one piece member. Nontheless, the present invention utilizes the face plate or equivalent means therefor to provide support of the edges of the slates or blades comprising the blind body. Referring specifically to FIG. 9 the angle member has respective legs 31A and 32A that respectively provide the above described face plate 31 and end plate 32. Each of the legs may be constructed of a pair of telescoping members 70 which are coaxial or folding members and include means for adjusting the length suck as pins inserting through horizontal corresponding holes formed therein or a frictional engagement for interlocking the coaxial members by twisting or rotating one member within the other.

Figures 5, 8:
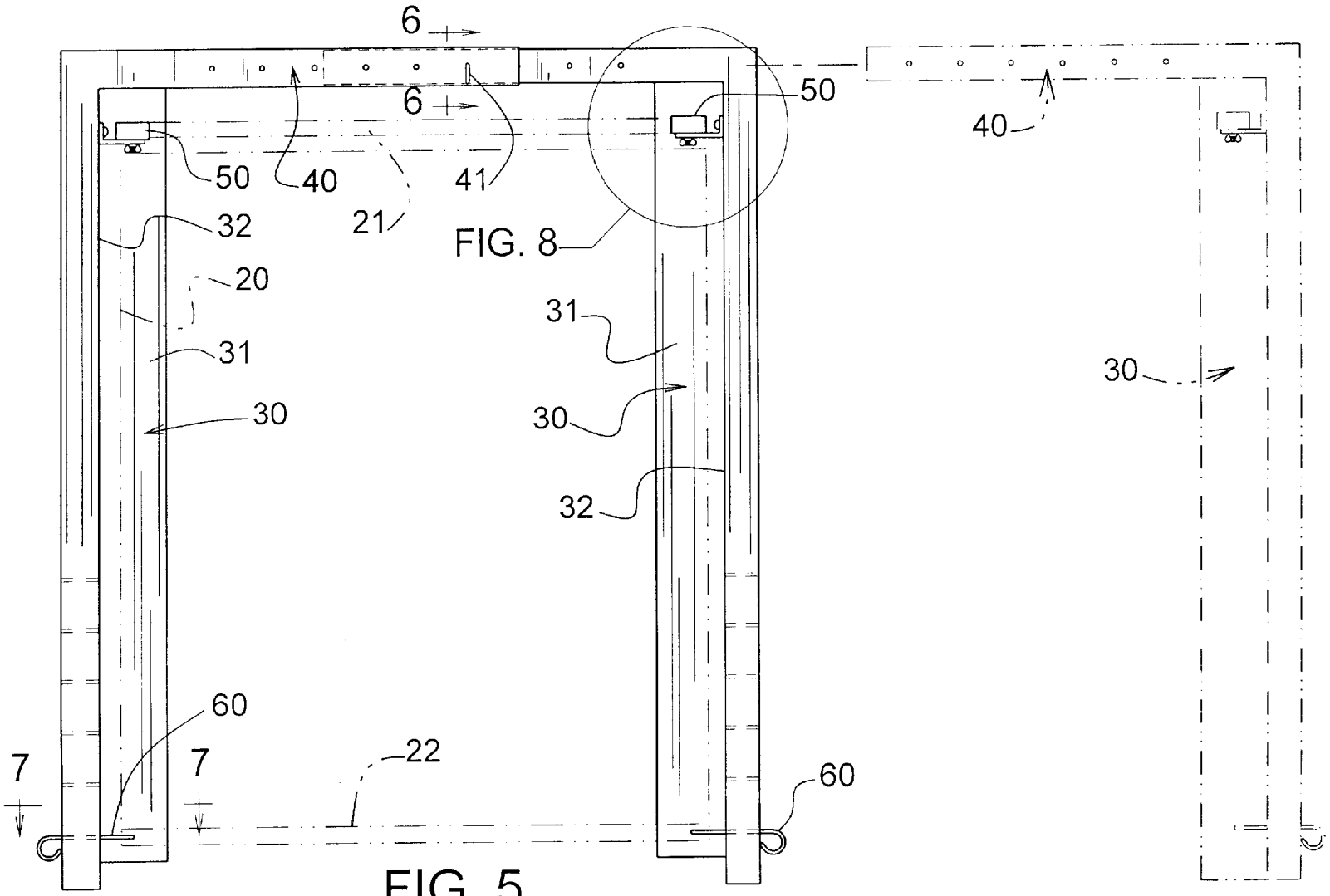
FIG. 5 is similar to FIG. 1 but illustrating some modifications.
FIG. 8 is an oblique exploded view of the encircled corner portion in FIG. 5 of the frame.
Figure 6:
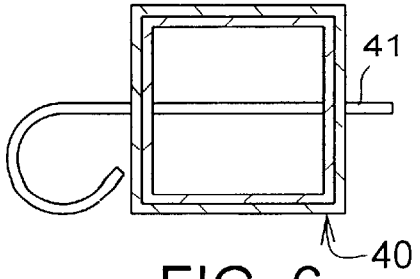
FIG. 6 is a sectional view taken along line 6—6 of FIG. 5.
Figure 7:
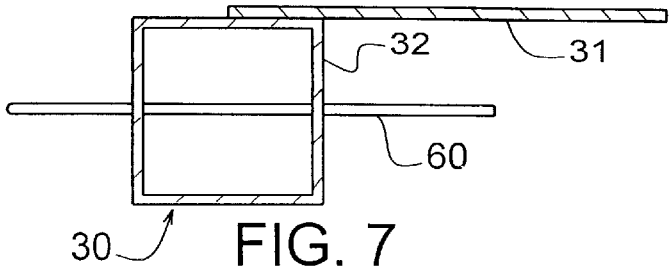
FIG. 7 is a sectional view taken along line 7—7 of FIG. 5.
Figure 8:
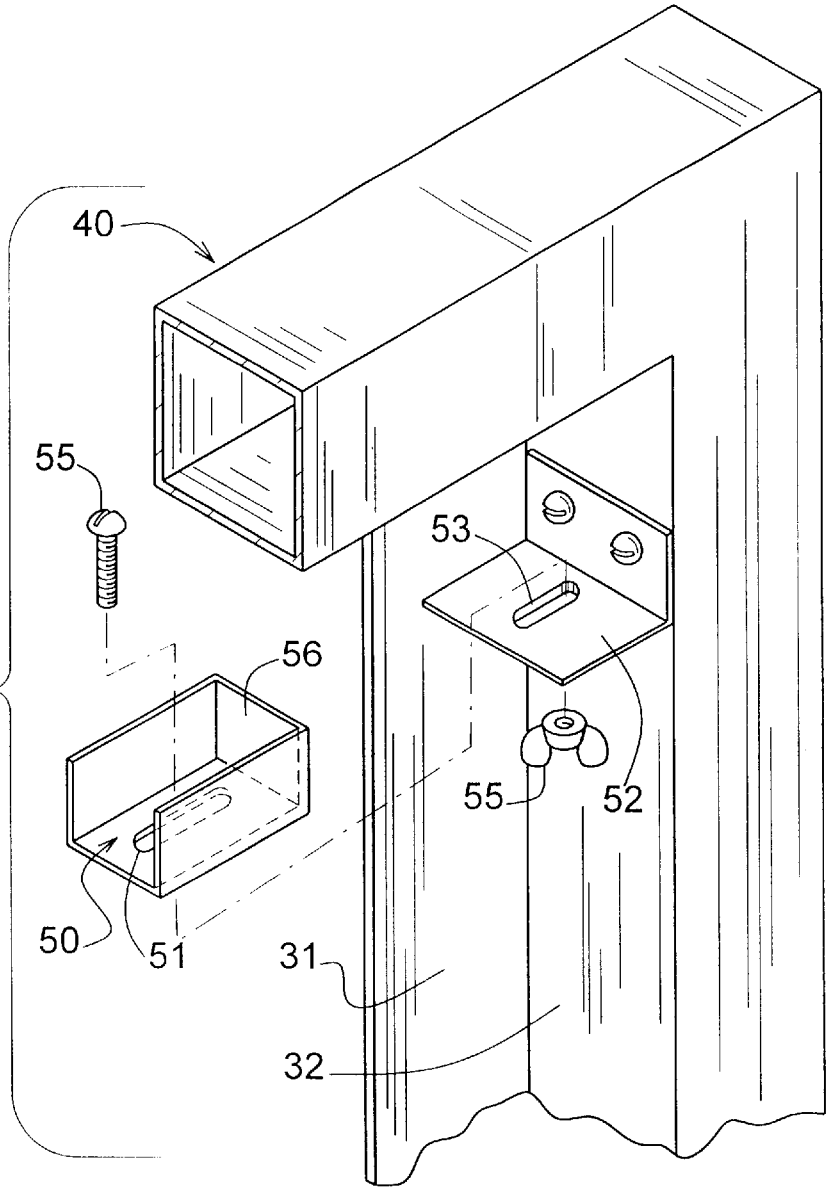

Means for releasibly supporting the head rail of a venetian blind comprises a pair of saddles 50. Each saddle 50 is a U-shape member or piece of channel with an elongate slot 51 in the web thereof for alignment and cooperative engagement with a bracket 52. The bracket 52 is attached to either the face plate 31 such as is shown in FIG. 4, or an end plate 32 as illustrated in FIG. 8 and is supported by the side member by any convenient means such as screw, tack, hook and loop fastener, flange or the like. The bracket has an elongate slot 53. A bolt and wing nut unit 55 joining the saddle and bracket and the elongate slots permit varying the space between the two saddles. The saddles have an end wall 56 for abutting against an adjacent end of the blind's top rail. The pair of saddles can thus readily be adjusted to abut against opposite ends of the blind top rail to prevent it from moving during cleaning.

The side rails each have a series of through holes 35 though which the pin 60 can be inserted into the end of the bottom rail 22. With the blind top rail 21 in the pair of saddles 50 the bottom rail can be pulled on to put some tension on the strip ladders of the blind. With some tension applied the pins can be inserted to hold the blind taut. With the blind in this position an end portion the slats bear against the face plate at the respective opposite ends of the slats. With the blind slats turned to their blind closed position for washing a face portion of the slats bear against the frame face plate. During washing the slats are prevented from moving endwise by the end edges of the slats abutting against the frame end plate 32.

The frame can be varied in width to match the width of various blinds and fine tuning to that width is made by moving the saddles 50 that support the top rail of the blind. The side members 30 of the forgoing blind support frame can have extensions thereon or attachable thereto or be long enough to support the blind at an elevated position for cleaning.

Figures 17, 18:
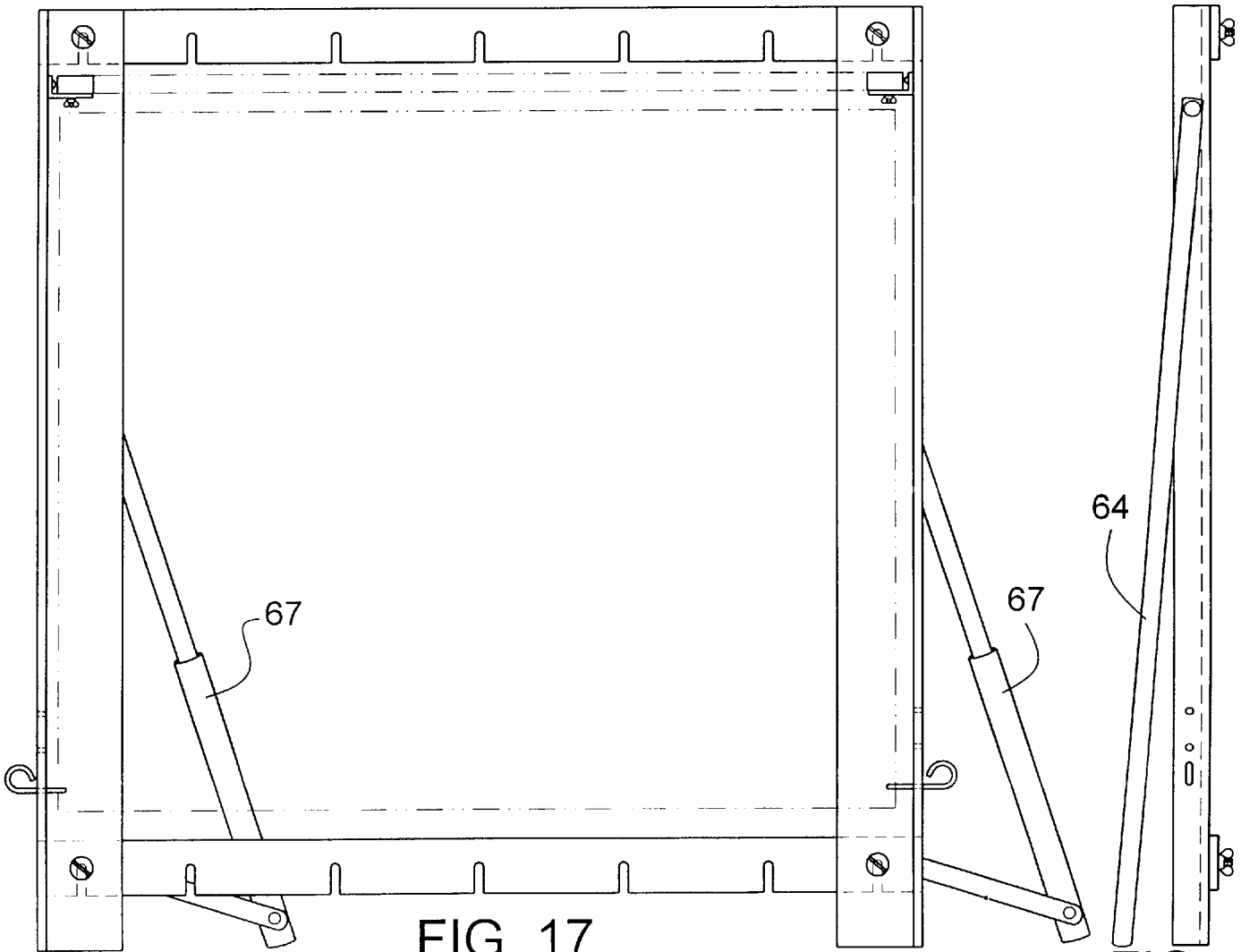
FIG. 17 is a perspective view of the present invention including telescoping support braces.
FIG. 18 is a side view of the present invention including pivotally connecting support braces.

A preferred embodiment includes a base member or foot 62 such as shown in FIG. 13 extending outwardly from and normal to each leg for supporting said blind cleaning support frame 10. One of more braces 64 extending from the top or side to the ground can be used to hold the frame 10 in an inclined position in various manners as is well known from the above references or in the art of artists self standing easels. The braces may be pivotally connected by a bolt rivet of the like such as best illustrated in FIG. 18 with means for limiting the extension thereof, or braces 67 may be formed by telescoping and interlocking members as best shown in FIG. 17. Of course the braces 64 can also interconnect the base member 62 with the leg members 31A and 32A.

It is also anticipated that one or more strips of resilient, preferably flexible material fabricated form plastic, cloth, wood, or metal extending in between said legs supported therein between. The vertical strips 66 can extend vertically form the top cross member 40 diagonally to a leg member to provide a support surface for the center section of the blind during cleaning with a tool which would tend to bend the blind slats.

For storage the side and cross members can be disassembled and bundled together in a compact package. In use the blind head rail is simply dropped into the spaced apart pair of saddles making mounting the blind for cleaning a quick and simple task.

The vertical and horizontal members may be fabricated form wood, plastic, aluminum, steel, or combinations thereof.

To use the present inventions, simply adjust the support stand to the size of the blind and lock in the frame members. Drop in the fixed blind holder. Let the blind extend to its full length and insert a pin thought the side member into the bottom of the blind. Dust the blind with a cloth to remove loose dust, then spray the blind with a cleaning solution. Wash the blind with warm soapy water with a sponge or soft cloth. Use a garden hose and rinse the blind with a fine mist of water, then let the blind dry in the sun. The window and wood work can be cleaned while the blind is drying.

The foregoing detailed description is given primarily for clearness of understanding and no unnecessary limitations are to be understood therefrom, for modifications will become obvious to those skilled in the art based upon more recent disclosures and may be made without departing form the spirit of the invention and scope of the appended claims.

We claim:

1. A blind cleaning support device, comprising:

a variable width frame for use in supporting a VENETIAN blind during cleaning, said VENETIAN blind having a plurality of slats;

said variable width frame including a pair of elongate side members defining legs, each one having a face plate and an end plate engagable respectively with a face portion and an end edge portion of each of said slats of said VENETIAN blind;

a cross member adjustably interconnecting said side members at various selected different positions to vary the width of the frame;

means for releasibly supporting the head rail of said VENETIAN blind;

means for mounting said saddle means on said frame; and means on said frame to releasibly anchor the bottom rail of said VENETIAN blind to said frame.

2. The blind cleaning support device of claim 1, wherein said means for releasibly supporting the head rail of a VENETIAN blind is a saddle.

3. The blind cleaning support frame as defined in claim 2 wherein said saddle defines a member mounted on each of said respective side members.

4. The blind cleaning support frame as defined in claim 2 wherein said saddle is adjustably movable.

5. The blind cleaning support device of claim 1, wherein said means mounting said means for releasibly supporting the head rail is a bracket having engagable slots therein.

6. The blind cleaning support device of claim 1, wherein said means for releasibly anchoring the bottom rail of the blind to said frame comprises pins.

7. The blind cleaning support frame as defined in claim 1 wherein said cross member is telescopically variable in length, said cross member including means to lock said cross member at various selected length positions.

8. The blind cleaning support frame of claim 1, including a base member defining a foot extending from the bottom of each of said legs normal thereto.

9. The blind cleaning support frame of claim 1, including a bottom rail interconnecting said side legs.

10. The blind cleaning support frame of claim 1, including strips extending inbetween said legs supported thereinbetween.

* * * * *